United States Patent [19]

Toshimitsu et al.

[11] Patent Number: 4,883,039

[45] Date of Patent: Nov. 28, 1989

[54] FUEL SUPPLY CONTROL METHOD FOR INTERNAL COMBUSTION ENGINES

[75] Inventors: Kazushige Toshimitsu; Masayuki Ueno; Hisashi Igarashi, all of Wako, Japan

[73] Assignee: Honda Giken Kogyo Kabushiki Kaisha, Tokyo, Japan

[21] Appl. No.: 252,378

[22] Filed: Sep. 30, 1988

Related U.S. Application Data

[62] Division of Ser. No. 130,635, Dec. 9, 1987, Pat. No. 4,825,834.

[30] Foreign Application Priority Data

Dec. 10, 1986 [JP] Japan ..... 61-294283
Dec. 10, 1986 [JP] Japan ..... 61-294286
Dec. 10, 1986 [JP] Japan ..... 61-294287

[51] Int. Cl.[4] ..... F02M 69/00

[52] U.S. Cl. ..... 123/463; 123/478; 123/492

[58] Field of Search ..... 123/478, 463, 491, 492, 123/179 L

[56] References Cited

U.S. PATENT DOCUMENTS

| | | | |
|---|---|---|---|
| 3,847,130 | 11/1974 | Miyoshi et al. | 123/179 L |
| 3,868,936 | 3/1975 | Rivere | 123/445 |
| 4,002,152 | 1/1977 | Hoshi | 123/487 X |
| 4,140,088 | 2/1979 | de Vulpillieres | 123/478 |
| 4,235,205 | 11/1980 | Fukui et al. | 123/478 |
| 4,242,992 | 1/1981 | Kawamura et al. | 123/491 |
| 4,315,491 | 2/1982 | Takeda | 123/478 |
| 4,418,672 | 12/1983 | Müller et al. | 123/478 |
| 4,424,785 | 1/1984 | Ishida et al. | 123/478 |
| 4,487,188 | 12/1984 | Inoue et al. | 123/491 |
| 4,494,511 | 1/1985 | Ito et al. | 123/463 |
| 4,546,732 | 10/1985 | Mae et al. | 123/478 |
| 4,612,904 | 9/1986 | Tadokoro et al. | 123/492 |
| 4,614,174 | 9/1986 | Tanigawa et al. | 123/478 |
| 4,768,486 | 9/1988 | Koike et al. | 123/478 X |

FOREIGN PATENT DOCUMENTS

| | | | |
|---|---|---|---|
| 52378 | 11/1982 | Japan | 123/492 |
| 2775 | 1/1986 | Japan . | |

*Primary Examiner*—Tony M. Argenbright
*Attorney, Agent, or Firm*—Lyon & Lyon

[57] ABSTRACT

A fuel supply control method for a multicylinder internal combustion engine equipped with a fuel supply control system including a main fuel injection valve disposed in the intake passage upstream of the throttle valve, and an auxiliary fuel injection valve disposed in the intake passage downstream of the throttle valve and upstream of the intake manifold, for controlling the fuel supply control system according to operating conditions of the engine. Fuel is supplied by the main fuel injection valve when the engine temperature is lower than a predetermined value, fuel is supplied by the auxiliary fuel injection valve when the engine temperature is higher than the predetermined value and the degree of opening of the throttle valve is smaller than a predetermined value, the fuel pressure applied to both the main fuel injection valve and the auxiliary fuel injection valve is regulated according to a predetermined parameter representing operating conditions of the engine, namely, pressure within the intake passage at a location downstream of the throttle valve, and the predetermined parameter is applied also to controlling the respective basic fuel injection periods of the main fuel injection valve and the auxiliary fuel injection valve.

6 Claims, 3 Drawing Sheets

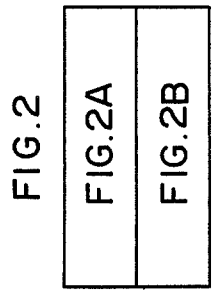
FIG.2
FIG.2A
FIG.2B
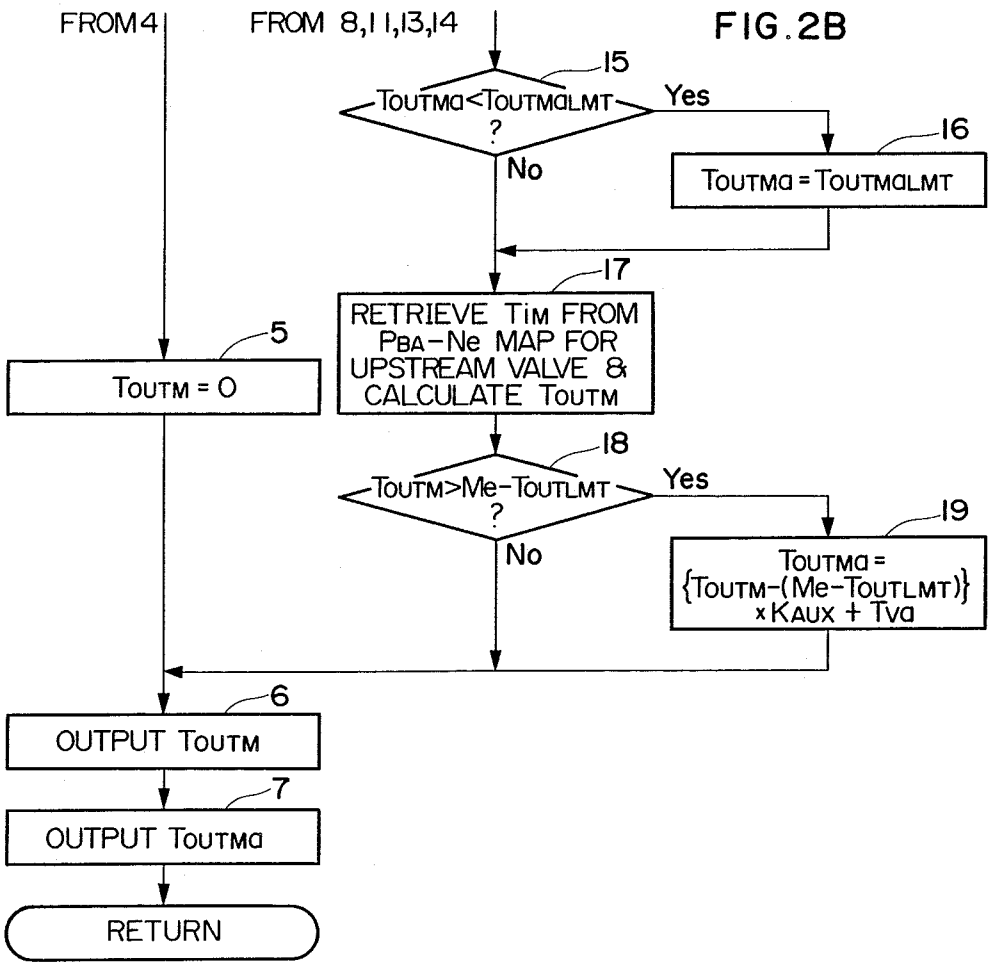
FIG.2B
FROM4
FROM 8,11,13,14
15
TOUTMa<TOUTMaLMT ?
Yes
No
16
TOUTMa=TOUTMaLMT
17
RETRIEVE TIM FROM PBA-Ne MAP FOR UPSTREAM VALVE & CALCULATE TOUTM
18
TOUTM>Me-TOUTLMT ?
Yes
No
19
TOUTMa= {TOUTM-(Me-TOUTLMT)} xKAUX + Tva
5
TOUTM=0
6
OUTPUT TOUTM
7
OUTPUT TOUTMa
RETURN

FUEL SUPPLY CONTROL METHOD FOR INTERNAL COMBUSTION ENGINES

This is a division of application Ser. No. 130,635, filed Dec. 9, 1987, now U.S. Pat. No. 4,825,834.

BACKGROUND OF THE INVENTION

1. Field of the Invention

The present invention relates to a fuel supply control method for internal combustion engines and, more particularly, the present invention relates to a fuel supply control method for an internal combustion engine having fuel injection valves provided upstream and downstream of the throttle valve in the suction pipe, respectively, to supply fuel to a plurality of cylinders.

2. Description of the Prior Art

A conventional fuel supply control system as disclosed in Japanese Provisional Patent Publication (Kokai) No. 47-35422 for distributing fuel injected by common fuel injection valves to the cylinders of an internal combustion engine controls the fuel supply so that fuel is supplied by a main fuel injection valve provided upstream of the throttle valve while the engine is operating in a middle load or high load mode, and fuel is supplied by an auxiliary fuel injection valve provided downstream of the throttle valve while the engine is operating in a low load mode. This fuel supply control system employs a fuel injection valve having excellent atomizing characteristics as the auxiliary fuel injection valve to secure uniform fuel distribution to all the cylinders during the low load operation of the engine, in which fuel is injected at a low rate.

According to this known fuel supply control method, fuel is allowed to flow smoothly without being obstructed by the throttle valve even when the throttle valve is fully or almost fully closed during the low load operation of the engine and hence fuel can be supplied to the cylinders with high responsiveness to the operating condition of the engine.

Fuel is satisfactorily atomized in the suction pipe when the engine is warm. Therefore, it is desirable to inject fuel by the auxiliary fuel injection valve having a fuel injection rate lower than that of the fuel injection valve disposed upstream of the throttle valve to supply fuel to the cylinders with high responsiveness to the engine operating condition and to secure accurate control of fuel being supplied at a very low fuel injection rate.

However, when the engine is cold, fuel cannot satisfactorily be atomized in the suction pipe because fuel is supplied at an increased rate by increasing the fuel injecting period of the auxiliary fuel injection valve and the suction pipe is cold. If the auxiliary fuel injection valve is disposed downstream of the throttle valve and near the intake manifold to avoid deterioration of fuel atomization, fuel injected by the auxiliary fuel injection valve cannot uniformly be distributed to the cylinders.

Further, in the conventional fuel supply control system, the fuel amount actually supplied to the cylinders varies if the working fuel injection valve is changed over from the auxiliary fuel injection valve disposed downstream of the throttle valve to the fuel injection valve disposed upstream of the throttle valve in response to change of the operating mode of the engine from the low load mode to the high load mode while the engine is cold. This is by the following reason: Upon the change of the operating mode the fuel injecting operation of the auxiliary fuel injection valve disposed downstream of the throttle valve injecting nearly the maximum fuel quantity is interrupted instantly and the fuel injection valve disposed upstream of the throttle valve starts injecting fuel at a high fuel injection rate. On such an occasion, dry inner surfaces of the throttle body and the suction pipe in the vicinity of the throttle valve are wetted by fuel injected by the upstream fuel injection valve. Since the lower the temperature of the inner wall of the intake pipe, the greater the amount of fuel that wets the inner surfaces of the throttle body and the suction pipe, the actual fuel amount supplied to the cylinders varies greatly at the time of changeover of the working fuel injection valve when the engine is cold. Accordingly, the aforementioned fuel supply control amount in changing over the working fuel injection valve from the auxiliary fuel injection valve to the upstream fuel injection valve.

In an internal combustion engine having a fuel supply system including a fuel injection valve for supplying fuel in common to a plurality of cylinders, disposed upstream of the throttle valve disposed upstream of the intake manifold, such as one stated above, a fuel pressure regulator regulates the fuel pressure, namely, the pressure of fuel supplied to the fuel injection valve, at a pressure higher by a fixed amount than pressure prevailing within the suction pipe in the vicinity of the nozzle of the fuel injection valve projected thereinto, namely, pressure within the suction pipe at a location upstream of the throttle valve to maintain the discharge pressure of the fuel injection valve constant. Such a fuel supply system is able to accurately meter the fuel supply amount according to the fuel injection period of the fuel injection valve. However, the same is unable to accurately meter the fuel supply amount over a wide range of fuel supply rate.

To deal with such a problem, Japanese Patent Publication (Kokoku) No. 61-2775 has proposed a fuel supply control method, which controls the pressure regulator to regulate the pressure of fuel supplied to the fuel injection valve disposed upstream of the throttle valve according to the pressure within the suction pipe at a location downstream of the throttle valve to secure accurate fuel supply amount over a wide range of fuel supply rate.

This proposed fuel supply control method also has a disadvantage. That is, the negative pressure within the suction pipe downstream of the throttle valve varies during operation of the engine in a low load mode such as an idling mode because the flow rate of intake air is controlled to vary in order to stabilize the engine speed at an idling speed according to variation of the engine speed, and variation of the magnitude of external load such as the air conditioner and the power steering system, and this variation of the intake air flow rate in turn causes variation of the suction pipe pressure downstream of the throttle valve, which makes it difficult to carry out accurate control of fuel supply so as to meet fuel demand. Consequently, highly accurate control of the air-fuel ratio of the mixture, which is particularly important while the engine is operating in a low load mode such as an idling mode, is difficult to carry out, rendering the combustion of fuel unstable and hence deteriorating exhaust emission characteristics of the engine.

On the other hand, while the engine is operating in an operating mode other than a low load mode, i.e. a middle load or high load mode, the fuel supply amount from the fuel injection valve need not be controlled very accurately. In a middle load or high load the fuel supply amount is rather to be controlled properly over a wide range of fuel supply rate to improve the driveability of the engine.

SUMMARY OF THE INVENTION

It is, therefore, an object of the invention to provide a fuel supply control method for an internal combustion engine, which is capable of controlling the fuel supply system of the engine so that fuel is distributed uniformly to all the cylinders while the engine is cold and avoiding variation of the fuel supply amount in changing the working fuel injection valve from the auxiliary fuel injection valve to the main fuel injection valve of the fuel supply system.

It is another object of the invention to provide a fuel supply control method for an internal combustion engine, which is capable of highly accurately controlling the air-fuel ratio of the mixture while the engine is operating in a low load mode to stabilize the combustion of fuel in the cylinders and to improve the exhaust emission characteristics, and which is also capable of controlling the fuel supply amount over a wide range of fuel supply rate while the engine is operating in an operating mode other than the low load mode to improve the driveability of the engine.

It is a further object of the invention to provide a fuel supply control method for an internal combustion engine, which is capable of accurately controlling the fuel supply amount regardless of variation of the discharge pressure of the fuel injection valves of the fuel supply system of the engine.

To attain the above objects, the present invention provides a method of controlling the supply of fuel to an internal combustion engine having a plurality of cylinders, an intake passage having an intake manifold connected to the cylinder, a throttle valve arranged in the intake passage at a location upstream of the intake manifold, at least one first fuel injection valve arranged in the intake passage at a location upstream of the intake manifold and downstream of the throttle valve, and at least one second fuel injection valve arranged in the intake passage at a location upstream of the throttle valve, wherein the first and second fuel injection valves are selectively operated to supply fuel to the cylinders in dependence on operating conditions of the engine.

In a first aspect of the invention, the method comprises the following step:

(a) detecting a temperature of the engine;

(b) detecting the degree of opening of the throttle valve;

(c) comparing the detected temperature of the engine with a predetermined value;

(d) comparing the detected degree of opening of the throttle valve with a predetermined value;

(e) operating the second fuel injection valve to supply fuel to the cylinders irrespective of the detected degree of opening of the throttle valve when the detected temperature of the engine is lower than the predetermined value; and (f) operating the first fuel injection valve to supply fuel to the cylinders when the detected temperature is higher than the predetermined value and at the same time the detected degree of opening of the throttle valve is smaller than the predetermined value.

In a second aspect of the invention, the method is applied to an internal combustion engine further having pressure regulating means for regulating the pressure of fuel supplied to both the first and second fuel injection valves. The method according to the second aspect of the invention comprises the following steps:

(a) detecting pressure within the intake passage at a location downstream of the throttle valve;

(b) regulating the pressure of fuel supplied to both the first and second fuel injection valves by means of the pressure regulating means in response to the detected pressure within the intake passage;

(c) detecting whether the engine is operating in a predetermined low load condition;

(d) operating the first fuel injection valve to supply fuel to the cylinders when it is detected that the engine is operating in the predetermined low load condition; and (e) operating at least the second fuel injection valve to supply fuel to the cylinders when it is detected that the engine is operating in an operating condition other than the predetermined low load condition.

In the above step (b), the pressure of fuel supplied to both the first and second fuel injection valves is regulated so that the difference between the pressure of fuel and the detected pressure within the intake passage is constant.

In a third aspect of the invention, basic fuel supply quantities to be supplied respectively by the first and second fuel injection valves are determined in response to operating conditions of the engine, and the first and second fuel injection valves are selectively operated to supply fuel in amounts corresponding to the respective determined fuel supply quantities to the cylinders in dependence on operating conditions of the engine. The method according to the third aspect of the invention comprises the following steps:

(a) detecting the value of a predetermined parameter indicative of load on the engine;

(b) regulating the pressure of fuel supplied to both the first and second fuel injection valves by means of the pressure regulating means in response to the detected value of the predetermined parameter; and (c) determining at least the basic fuel supply quantity to be supplied by the second fuel injection valve in response to the detected value of the predetermined parameter.

Preferably, the predetermined parameter is absolute pressure within the intake passage at a location downstream of the throttle valve.

Also preferably, the above step (c) comprises determining a value of discharge pressure of at least the second fuel injection valve from the detected value of the predetermined parameter, determining a value of a required fuel supply quantity to be supplied by at least by the second fuel injection valve from the detected value of the predetermined parameter, and determining the basic fuel supply quantity to be supplied by at least the second fuel injection valve on the basis of the determined value of the discharge pressure and the determined value of the required fuel supply quantity.

The above and other objects, features and advantages of the present invention will become apparent from the following description taken in conjunction with the accompanying drawings.

BRIEF DESCRIPTION OF THE DRAWINGS

FIGS. 2, 2A and 2B are a fuel supply control program to be executed by an electronic control unit shown in FIG. 1.

DETAILED DESCRIPTION

The invention will now be described with reference to the drawings showing a preferred embodiment thereof.

Figure 1:
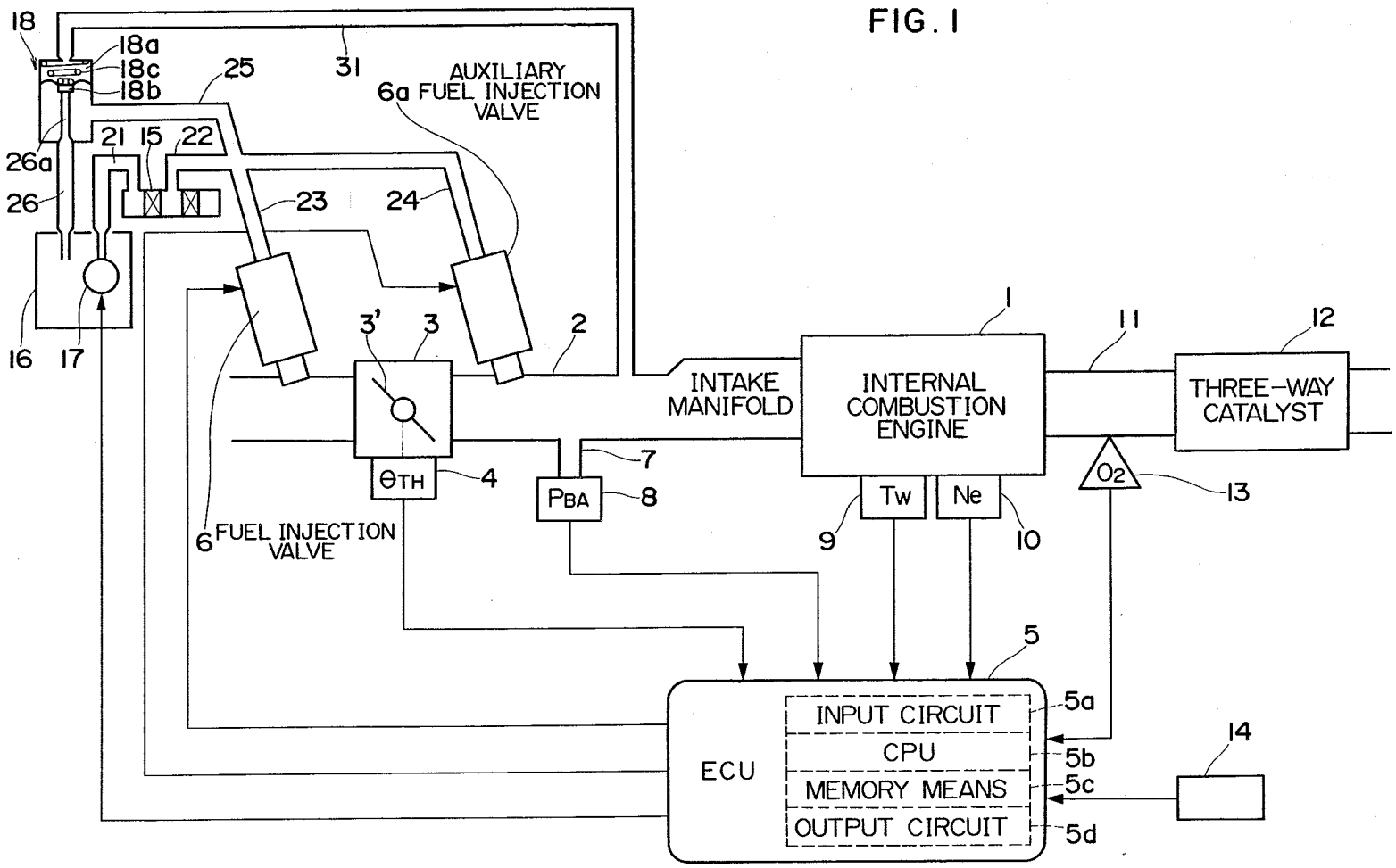
FIG. 1 is a diagrammatic illustration showing the general construction of a fuel supply control system for an internal combustion engine, for carrying out a fuel supply control method, in a preferred embodiment, according to the invention.

Referring to FIG. 1, a suction pipe (intake passage) 2 is connected through an intake manifold to an internal combustion engine 1 such as a four-cylinder internal combustion engine (hereinafter referred to simply as "the engine" ). The suction pipe 2 is provided with a throttle body 3 internally provided with a throttle valve 3' upstream of the intake manifold. A throttle angle sensor ($\theta_{TH}$ TH sensor) 4 is associated with the throttle valve 3' to give an electric signal representing the throttle angle, namely, the degree of opening, of the throttle valve 3' to an electronic control unit (hereinafter abbreviated to "the ECU" ) 5.

A fuel injection valve 6 is disposed in the suction pipe 2 at a location slightly upstream of the throttle body 3 with respect to the direction of flow of intake air to supply fuel to all the cylinders of the engine 1 while the engine 1 is operating in a middle-load or high-load mode. An auxiliary fuel injection valve 6a is disposed in the suction pipe 2 at a location slightly downstream of the throttle body 3 and upstream of the intake manifold with respect to the direction of flow of intake air to supply fuel to all the cylinders while the engine 1 is operating in a low load mode after the same has sufficiently warmed up. The fuel injection valve 6 and the auxiliary fuel injection valve 6a are electrically connected to the ECU 5. The ECU 5 controls the respective fuel injection periods $T_{OUTM}$ and $T_{OUTMa}$ of the fuel injection valve 6 and the auxiliary fuel injection valve 6a.

An absolute pressure sensor ($P_{BA}$ sensor) 8 is connected through a connecting tube 7 to the interior of the suction pipe 2 at a location downstream of the throttle valve 3' of the throttle body 3 to give an electric signal representing absolute pressure within the suction pipe 2.

The fuel injection valve 6 and the auxiliary fuel injection valve 6a are connected through a conduit line 21, a strainer 15 and conduit lines 22, 23 and 24 to a fuel pump 17 provided in a fuel tank 16. The fuel pump 17 is controlled by the ECU 5. The conduit lines 22, 23 and 24 are connected through a conduit line 25, a fuel pressure regulator 18 and a pipe 26 to the fuel tank 16. The fuel pressure regulator 18 regulates the fuel pressure in the conduit lines 22 to 25 according to negative pressure (absolute pressure $P_{BA}$) in the suction pipe at a location downstream of the throttle valve 3'. The fuel pressure regulator 18 has a negative pressure chamber 18a connected through a conduit line 31 to the interior of the suction pipe 2 at a location downstream of the throttle valve 3', the pipe 26 having one end immersed in fuel contained in the fuel tank 16 and the other open end 26a, a valve element 18b seated on the open end 26a of the pipe 26 for closing and opening same, and a coil spring 18c urging the valve element 18b against the open end 26a of the pipe 26. The position of the valve element 18b is dependent on the difference between the resilient force of the coil spring 18c and the negative pressure in the suction pipe 2 at the location downstream of the throttle valve 3', so that the difference between the fuel pressure (absolute pressure) in the conduit lines 22 to 25 and the absolute pressure $P_{BA}$ in the suction pipe 2 at the location downstream of the throttle valve 3' is always constant. Accordingly, the differential fuel discharge pressure of the auxiliary fuel injection valve 6a is constant irrespective of the magnitude of the absolute pressure $P_{BA}$ and hence the fuel injection quantity of the auxiliary fuel injection valve 6a is dependent only on the fuel injection period $T_{OUTMa}$ thereof, whereby the fuel injection quantity of the auxiliary fuel injection valve 6a can be accurately controlled.

On the other hand, since the pressure in the suction pipe upstream of the throttle valve 3' is always substantially the same as or near atmospheric pressure, the fuel discharge pressure Pb of the fuel injection valve 6 varies with absolute pressure $P_{BA}$ in the suction pipe 2 downstream of the throttle valve 3'. That is, since the fuel pressure in the conduit lines 22 to 25 decreases as the absolute pressure $P_{BA}$ in the suction pipe 2 downstream of the throttle valve 3' decreases when the engine 1 is operating in a low load mode, the fuel discharge pressure Pb of the fuel injection valve 6 decreases accordingly. When the engine 1 is operating in a high load mode, the fuel pressure in the conduit lines 22 to 25 increases as the absolute pressure $P_{BA}$ in the suction pipe 2 downstream of the throttle valve 3' increases, and hence the fuel discharge pressure Pb of the fuel injection valve 6 increases accordingly. Thus, while the engine 1 is operating in a low load mode, the lower the fuel pressure the longer the fuel injection period $T_{OUTM}$ of the fuel injection valve 6 for the same fuel injection quantity and hence the fuel quantity to be injected at a small injection rate can be accurately controlled. While the engine 1 is operating in a high load mode, the fuel injection valve 6 injects fuel at a high injection rate in a short fuel injection period $T_{OUTM}$ to supply fuel at a high rate so that the engine 1 is able to generate high power.

Predetermined values of basic fuel injection periods $T_{iM}$ and $T_{iMa}$ for the fuel injection valve 6 and the auxiliary fuel injection valve 6a are written in maps stored in the memory 5c of the ECU 5. Two engine operating parameters, namely, absolute pressure $P_{BA}$ within the suction pipe 2 and engine speed Ne, are used for retrieving the predetermined values of basic fuel injection periods $T_{iM}$ and $T_{iMa}$. Each predetermined value of basic fuel injection period $T_{iMa}$ for the auxiliary fuel injection valve 6a corresponding to a certain required air-fuel ratio A/F is set at a value proportional to a corresponding required fuel supply quantity Qf as in an ordinary fuel injection period map. Therefore, the fuel supply quantity can be accurately controlled even if the required fuel supply rate is very small. On the other hand, each predetermined value of basic fuel injection period $T_{iM}$ for the fuel injection valve 6 is a value set by taking into account the discharge pressure Pd, through the following procedure. As mentioned above, the discharge pressure Pd of the fuel injection valve 6 varies with variation of the absolute pressure $P_{BA}$ in the suction pipe 2 at the location downstream of the suction valve 3'. Therefore, a plurality of predetermined values of discharge pressure $P_D$ corresponding respectively to a plurality of predetermined values of absolute pressure $P_{BA}$ are determined beforehand, a plurality of predetermined values of required fuel supply quantity Qf corresponding respectively to a plurality of predetermined sets of values of engine speed Ne and absolute pressure $P_{BA}$ in the suction pipe are determined, a plurality of predetermined values of each of basic fuel injection period $T_{iM}$ and basic fuel injection period $T_{iMa}$ corresponding respectively to a plurality of predetermined sets of the predetermined values of discharge pressure Pd and required fuel supply quantity Qf are determined, and then the predetermined values of each of basic fuel injection periods $T_{iM}$ and $T_{iMa}$ are written into the respective map (hereinafter referred to as "the $P_{BA}$-Ne map" ).

That is, since the discharge pressure $P_D$ is dependent on the absolute pressure $P_{BA}$ in the suction pipe, and the absolute pressure $P_{BA}$ in the suction pipe serves as a parameter of the load on the engine for determining the basic fuel injection periods $T_{iM}$ and $T_{iMa}$, two phenomena, namely, discharge pressure $P_D$ and charging efficiency for each cylinder can be expressed on the $P_{BA}$-Ne map. Therefore, predetermined values of basic fuel injection periods $T_{iM}$ and $T_{iMa}$ determined on the basis of those two phenomena are written in the $P_{BA}$-Ne map. That is, the basic fuel injection periods $T_{iM}$ and $T_{iMa}$ written in the $P_{BA}$-Ne map are determined taking the discharge pressure $P_D$ corresponding to the absolute pressure $P_{BA}$ into consideration, in addition to the charging efficiency corresponding to combinations of $P_{BA}$ values and Ne values as employed in a conventional $P_{BA}$-Ne map.

A temperature sensor (hereinafter referred to as "the TW sensor" ) 9 for detecting the temperature of the engine cooling water is provided in the engine 1. The TW sensor 9 comprises a thermistor or the like disposed in the water jacket filled with engine cooling water. The TW sensor 9 gives a temperature signal representing the temperature of the engine cooling water to the ECU 5. An engine speed sensor (hereinafter referred to as "the Ne sensor" ) 10 is disposed in facing relation to the camshaft, not shown, or the crankshaft, not shown, of the engine 1. The Ne sensor 10 gives ECU 5 a crank angle signal (hereinafter referred to as "the TDC signal" ) representing a predetermind crank angle before a top dead center TDC of the piston of each cylinder, at which the suction stroke of the piston of the cylinder is started, to the whenever the crankshaft rotates through an angle of 180° .

The exhaust pipe 11 of the engine 1 is provided with a three-way catalyst unit 12 for purifying noxious components, such as HC, CO and NOx, in the exhaust gases. An oxygen sensor 13 is provided in the exhaust pipe 11 upstream the three-way catalyst unit 12 to detect oxygen concentration in the exhaust gases and to give an oxygen concentration signal to the ECU 5.

Other parameter sensors 14, including an atmospheric pressure sensor, are connected to the ECU 5 The other parameter sensors 14 give detection signals to the ECU 5.

The ECU 5 comprises an input circuit **5*a* which shapes the respective waveforms of input signals received from some of the sensors, adjusts the respective voltage levels of input signals from other sensors to a predetermined level and converts the respective analog values of the voltage-adjusted input signals to corresponding digital values, a central processing unit (hereinafter abbreviated to "the CPU" ) 5*b*, the memory 5*c* which stores programs to be executed by the CPU 5*b* and results of operations executed by the CPU 5*b*, and an output circuit 5*d* which gives driving signals to the fuel injection valve 6 and the auxiliary fuel injection valve 6*a***.

Figure 2A:
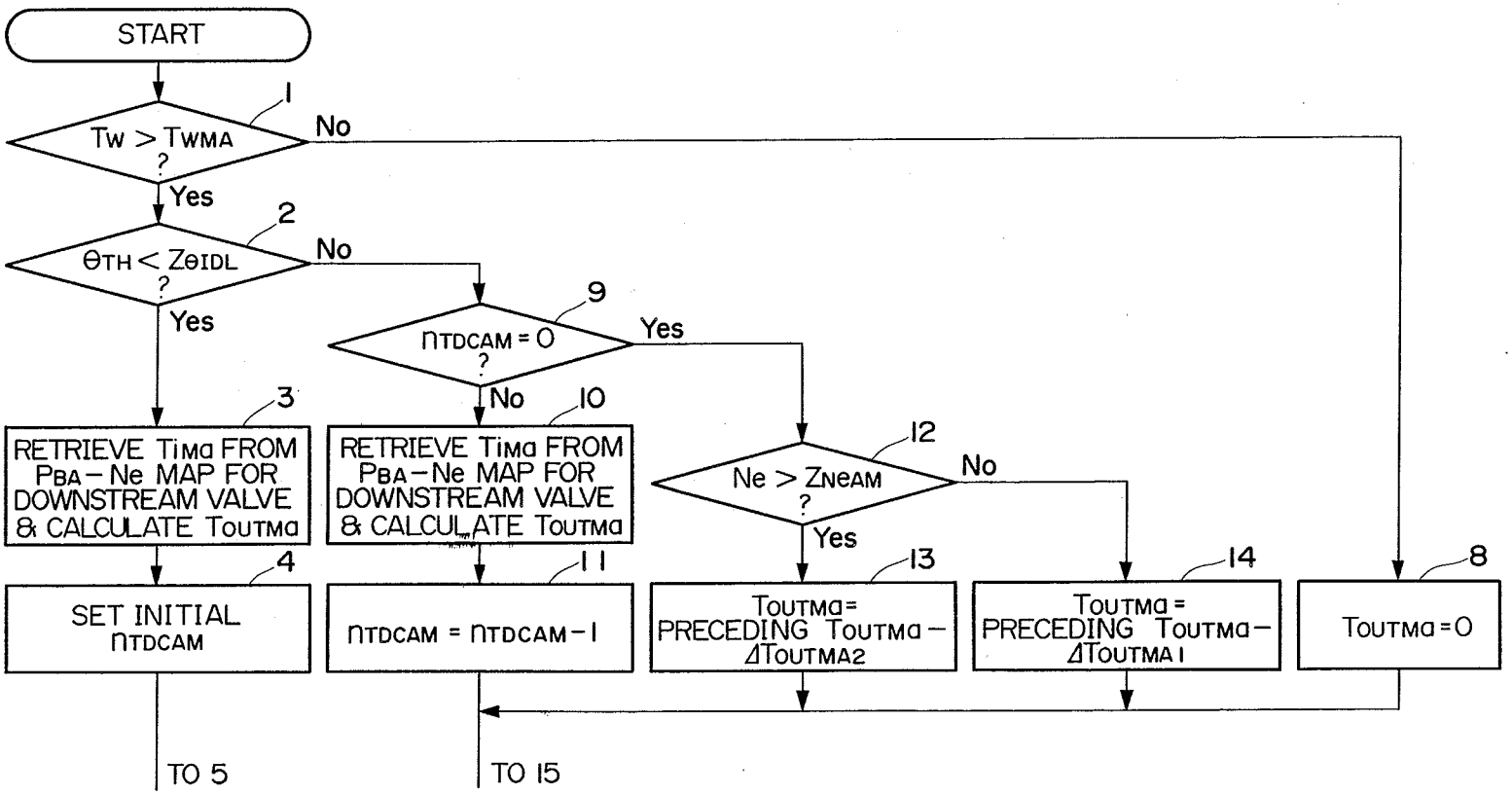

The CPU **5*b* executes a fuel supply control program shown in FIG. 2 in synchronism with generation of each pulse of the TDC signal to calculate the respective fuel injection periods of the fuel injection valve (hereinafter referred to as "the upstream valve" ) 6 provided upstream of the throttle valve, and the auxiliary fuel injection valve (hereinafter "the downstream valve" ) 6*a* provided downstream of the throttle valve, on the basis of the output signals of the aforementioned engine operating parameter signals, and to give the upstream valve 6 and the downstream valve 6*a*** driving signals corresponding to respective calculated fuel injection periods.

The fuel supply control program of FIG. 2 will be described in detail hereinafter. The fuel supply control program is executed in synchronism with generation of each pulse of the TDC signal.

In step 1, a decision is made as to whether the temperature TW of the engine cooling water is higher than a predetermined value $T_{WMA}$ (for example, 60° C). When the answer to step 1 is "No", namely, when the temperature of the engine is lower than the predetermined value $T_{WMA}$, the injection period $T_{OUTMa}$ of the downstream valve **6*a* is set to zero in step 8. Then, step 15 and the following steps are executed to retrieve a value of basic injection period $T_{iM}$ from the $P_{BA}$-Ne map for the upstream valve 6, to calculate the valve opening or injection period $T_{OUTM}$ of the upstream valve 6** on the basis of the retrieved value of basic injection period $T_{iM}$ by using the following expression, and to give a driving signal corresponding to the calculated injection period $T_{OUTM}$:

$$T_{OUTM}=T_{iM}\times K_{1M}+K_{2M}\ \text{tm} \quad (1)$$

where $K_{1M}$ and $K_{2M}$ are correction coefficients and correction constants, respectively, which are determined on the basis of engine operating parameter signals.

Thus, fuel is distributed evenly to all the cylinders of the engine 1 because fuel is supplied by the upstream valve 6 while the engine 1 is cold.

When the answer to step 1 is "Yes", a decision is made in step 2 as to whether the throttle angle $\theta_{TH}$ is smaller than a predetermined low value $Z\theta_{IDL}$ (for example, 0.39° ). When the answer to step 2 is "Yes", namely, when the engine temperature is higher than the predetermined value $T_{WMA}$ and the throttle angle is smaller than the predetermined low value, a value of basic injection period $T_{iMa}$ for the downstream valve **6*a* is retrieved from the $P_{BA}$-Ne map for the downstream valve 6*a*, and then the injection period $T_{OUTMa}$ for the downstream valve 6*a* is calculated in step 3** on the basis of the $T_{iMa}$ by using the following expression:

$$T_{OUTMa}=T_{iMa}\times K_{1a}+K_{2a} \quad (2)$$

where $K_{1a}$ and $K_{2a}$ are correction coefficients and correction constants, respectively, which are determined on the basis of engine parameter signals.

Then, a control value $n_{TDCAM}$, which is used in step 9, is set to an initial value (for example, "3" ) in step 4, and the injection period $T_{OUTM}$ of the upstream valve 6 is set to "0" in step 5. Accordingly, no driving signal is given to the upstream valve 6 when step 6 is executed. In step 7, a driving signal corresponding to the value of $T_{OUTMa}$ calculated in step 3 is supplied to the downstream valve **6*a*** to open same, and then the program is ended. Thus, fuel is supplied to the cylinders with high responsiveness to the calculated injection period.

When the answer to step 2 is "No", a decision is made in step 9 as to whether the value $n_{TDCAM}$ is "0". When the answer to step 9 is "No", a value of basic injection period $T_{iMa}$ is retrieved, similarly to step 3, from the $P_{BA}$-Ne map for the downstream valve 6a, and then the injection period $T_{OUTMa}$ for the downstream valve 6a is calculated on the basis of the retrieved value of $T_{iMa}$ in step 10. Then, "1" is subtracted from the value $n_{TDCAM}$ in step 11, and then step 15 and the following steps are executed.

When the answer to step 9 is "Yes", the value $T_{OUTMa}$ calculated in step 10 is reduced at a reduction rate corresponding to the engine speed Ne in steps 12 and 13 or in steps 12 and 14. That is, a decision is made in step 12 as to whether the engine speed Ne is higher than a predetermined value $Z_{NeAM}$ (for example, 900 rpm). When the answer to step 12 is "Yes", the preceding value $T_{OUTMa}$ is reduced by a decrement $\Delta T_{OUTMa2}$ (for example, 0.8 msec). When the answer to step 12 is "No", the preceding value $T_{OUTMa}$ is reduced by a decrement $\Delta T_{OUTMa1}$ (for example, 1.0 msec), and then step 15 and the following steps are executed.

In step 15, a decision is made as to whether the value $T_{OUTMa}$ calculated in steps 10, 13 or 14 is smaller than a lower limit $T_{OUTMaLMT}$ (for example, 3.0 msec). When the answer to step 15 is "Yes", the value $T_{OUTMa}$ is set to the lower limit $T_{OUTMaLMT}$ in step 16, and then step 17 is executed. When the answer to step 15 is "No", the routine goes directly to step 17. In step 17, a value of basic injection period $T_{iM}$ is retrieved from the $P_{BA}$-Ne map for the upstream valve 6, and then the injection period $T_{OUTM}$ for the upstream valve 6 is calculated by using the expression (1).

In step 18, a decision is made as to whether the value $T_{OUTM}$ calculated in step 17 is greater than a predetermined value Me - $T_{OUTLMT}$. The value Me is the interval between adjacent pulses of the TDC signal corresponding to the duration of the suction stroke, and $T_{OUTLMT}$ represents the injection period of the downstream valve 6a for high load operation of the engine 1 but is expressed in terms of an injection period of the upstream valve 6 by converting the former into the latter, and hence $T_{OUTLMT}$ corresponds to the fuel supply quantity from the downstream valve 6a. Accordingly, the predetermined value Me - $T_{OUTLMT}$ represents the maximum fuel amount that is actually directly drawn into the cylinders, of the fuel quantity injected by the upstream valve 6. When the value $T_{OUTM}$ is greater than the predetermined value Me - $T_{OUTLMT}$, excessive fuel wets the throttle valve, etc., then is evaporated, and then wets the inner wall surface of the suction pipe 2 downstream of the throttle valve. If an amount of fuel corresponding to the amount of fuel wetting the inner wall surface of the suction pipe downstream of the throttle valve is supplied by the downstream valve 6a, the evaporation rate of fuel on the throttle valve is reduced, which reduces the variation of the amount of fuel wetting the throttle valve, etc. and hence improves the accuracy of fuel supply control. Therefore, when the answer to step 18 is "Yes", the injection period for the downstream valve 6a is calculated in step 19 by using the following expression:

$$T_{OUTMa}=[T_{OUTM}-(Me-T_{OUTLMT})]\times K_{AUX}+Tva \quad (3)$$

where $K_{AUX}$ is the ratio of the injection rate of the downstream valve 6a to that of the upstream valve 6, and Tva is a correction value corresponding to the voltage of the battery. After step 19 has been executed, step 6 is executed. When supply of an amount of fuel corresponding to an amount of fuel wetting the throttle valve and the inner wall surface of the suction pipe 2 is not required, for instance when the engine 1 is decelerating, the answer to step 18 should be "No". In such a case, the routine goes directly to step 6 skipping step 19.

In step 6, a driving signal corresponding to the value $T_{OUTM}$ is given to the upstream valve, a driving signal corresponding to the value $T_{OUTMa}$ is given to the downstream valve, and then the program is ended.

In the above described manner, fuel is distributed evenly or uniformly to all the cylinders even when the engine is cold, the working fuel injection valve need not be changed over from the downstream valve 6a to the upstream valve 6 when the operating mode of the engine changes from a low load mode to a high load mode while the engine is cold, and hence adverse variation of the fuel supply amount does not occur, which would otherwise be caused by changeover of the working fuel injection valve. Furthermore, when the engine is warm, the working fuel injection valve is changed over, namely, the upstream valve 6 is started to operate together with the downstream valve 6a, when the throttle valve is opened above the predetermined small throttle angle $Z0_{IDL}$, namely, at the moment the flow rate of intake air has just started varying. Hence, it is possible to secure a fuel supply amount in response to variation of the flowing condition of intake air through the suction pipe, as distinct from the control manner that the downstream valve injecting nearly the maximum fuel quantity is interrupted instantly and the upstream valve starts injecting at a high injection rate, causing a large variation in the fuel supply amount and hence variation of the air-fuel ratio.

Although the invention has been described in its preferred form with a certain degree of particularity, obviously many changes and varations are possible in the light of the above teachings. It is therefore to be understood that the present invention may be practiced otherwise than as specifically described without departing from the scope and spirit thereof.

What is claimed is:

1. A method of controlling the supply of fuel to an internal combustion engine having a plurality of cylinders, an intake passage having an intake manifold connected to said cylinders, a throttle valve arranged in said intake passage at a location upstream of said intake manifold, at least one first fuel injection valve arranged in said intake passage at a location upstream of said intake manifold and downstream of said throttle valve, at least one second fuel injection valve arranged in said intake passage at a location upstream of said throttle valve, and pressure regulating means for regulating the pressure of fuel supplied to both said first and second fuel injection valves, wherein said first and second fuel injection valves are selectively operated to supply fuel to said cylinders in dependence on operating conditions of said engine, the method comprising the steps of:

(a) detecting pressure within said intake passage at a location downstream of said throttle valve;

(b) regulating the pressure of fuel supplied to both said first and second fuel injection valves by means of said pressure regulating means in response to the detected pressure within said intake passage in a manner such that said first fuel injection valve has a discharge pressure thereof maintained constant and said second fuel injection valve has a discharge pressure thereof variable with the pressure within said intake passage;

(c) detecting whether said engine is operating in a predetermined low load condition;

(d) operating said first fuel injection valve to supply fuel to said cylinders when it is detected that said engine is operating in said predetermined low load condition; and (e) operating at least said second fuel injection valve for a fuel injection period which is determined based at least in part on a value of said discharge pressure of said second fuel injection valve determined from the detected pressure within said intake passage, to supply fuel to said cylinders when it is detected that said engine is operating in an operating condition other than said predetermined low load condition.

2. A method as claimed in claim 1, wherein in said step (b), the pressure of fuel supplied to both said first and second fuel injection valves is regulated so that the difference between the pressure of fuel and the detected pressure within said intake passage is constant.

3. A method of controlling the supply of fuel to an internal combustion engine having a plurality of cylinders, an intake passage having an intake manifold connected to said cylinders, a throttle valve arranged in said intake passage at a location upstream of said intake manifold, at least one first fuel injection valve arranged in said intake passage at a location upstream of said intake manifold and downstream of said throttle valve, at least one second fuel injection valve arranged in said intake passage at a location upstream of said throttle valve, and pressure regulating means for regulating the pressure of fuel supplied to both said first and second fuel injection valves, wherein basic fuel supply quantities to be supplied respectively by said first and second fuel injection valves are determined in response to operating conditions of said engine, and said first and second fuel injection valves are selectively operated to supply fuel in amounts corresponding to the respective determined fuel supply quantities to said cylinders in dependence on operating conditions of said engine, the method comprising the steps of:

(a) detecting the value of a predetermined parameter indicative of load on said engine, (b) regulating the pressure of fuel supplied to both said first and second fuel injection valves by means of said pressure regulating means in response to the detected value of said predetermined parameter in a manner such that said first fuel injection valve has a discharge pressure thereof maintained constant and said second fuel injection valve has a discharge pressure thereof variable with the value of said predetermined parameter; and (c) determining a value of said discharge pressure of said second fuel injection valve in response to the detected value of said predetermined parameter and thereafter determining a basic fuel injection period for which said second fuel injection valve is to be open on the basis of the thus determined value of said discharge pressure and said determined basic fuel supply quantity to be supplied by said second fuel injection valve.

4. A method as claimed in claim 3, wherein said predetermined parameter is absolute pressure within said intake passage at a location downstream of said throttle valve.

5. A method as claimed in claim 7, wherein said step (c) comprises determining a value of discharge pressure of at least said second fuel injection valve from the detected value of said predetermined parameter, determining a value of a required fuel supply quantity to be supplied by at least said second fuel injection valve from the detected value of said predetermined parameter, and determining said basic fuel injection period for which at least said second fuel injection valve is to be open on the basis of the determined value of said discharge pressure and the determined value of said required fuel supply quantity.

6. A method of controlling the supply of fuel to an internal combustion engine having a plurality of cylinders, an intake passage having an intake manifold connected to said cylinders, a throttle valve arranged in said intake passage at a location upstream of said intake manifold, at least one first fuel injection valve arranged in said intake passage at a location upstream of said intake manifold and downstream of said throttle valve, at least one second fuel injection valve arranged in said intake passage at a location upstream of said throttle valve, and pressure regulating means for regulating the pressure of fuel supplied to both said first and second fuel injection valves, wherein basic fuel supply quantities to be supplied respectively by said first and second fuel injection valves are determined in response to operating conditions of said engine, and said first and second fuel injection valves are selectively operated to supply fuel in amounts corresponding to the respective determined fuel supply quantities to said cylinders in dependence on operating conditions of said engine, the method comprising the steps of:

(a) detecting the value of a predetermined parameter indicative of load on said engine;

(b) regulating the pressure of fuel supplied to both said first and second fuel injection valves by means of said pressure regulating means in response to the detected value of said predetermined parameter; and (c) determining a value of discharge pressure of at least said second fuel injection valve from the detected value of said predetermined parameter, determining a value of a required fuel supply quantity to be supplied by at least said second fuel injection valve from the detected value of said predetermined parameter, and determining a basic fuel injection period for which at least said second fuel injection valve is to be open on the basis of the determined value of said discharge pressure and the determined value of said required fuel supply quantity.

* * * * *